United States Patent [19]

Thalhamer

[11] 4,199,006

[45] Apr. 22, 1980

[54] PNEUMATIC VALVE

[75] Inventor: Arnold G. Thalhamer, Waldorf, Md.

[73] Assignee: The United States of America as represented by the Secretary of the Navy, Washington, D.C.

[21] Appl. No.: 882,040

[22] Filed: Feb. 28, 1978

[51] Int. Cl.[2] ..... F16K 31/12

[52] U.S. Cl. ..... 137/599; 114/54; 251/26

[58] Field of Search ..... 114/52, 53, 54, 333, 114/334, 335; 137/599; 91/6; 251/26, 25

[56] References Cited

U.S. PATENT DOCUMENTS

| | | | |
|---|---|---|---|
| 216,766 | 5/1939 | Thomason | 251/26 X |
| 299,482 | 9/1961 | Bower | 91/6 X |
| 966,353 | 8/1910 | Petigor | 137/599 X |
| 1,863,732 | 6/1932 | Schwager | 114/54 |
| 2,367,682 | 1/1945 | Kehle . | |
| 2,588,202 | 3/1952 | Breit et al. | 251/25 X |
| 2,887,080 | 5/1959 | Fedrowich | 114/54 |
| 3,480,029 | 11/1969 | Cole . | |
| 3,701,363 | 10/1972 | Schuler . | |
| 3,776,422 | 12/1973 | Wise . | |
| 3,813,177 | 5/1974 | Cartwright . | |
| 3,836,167 | 9/1974 | Wilson . | |

*Primary Examiner*—Robert G. Nilson

*Attorney, Agent, or Firm*—R. S. Sciascia; Sol Sheinbein; William C. Anderson

[57] ABSTRACT

A pneumatic valve for controlling the inflation of floatation bladders in diver-deployed underwater recovery apparatus comprises, in one embodiment, an inlet connectable to a source of pressurized air, two small semicircular flow passages joining the inlet to an outlet which connects to the bladders, a pair of spring-biased control pistons mounted in parallel in the two flow passages and another spring-biased outlet piston in a larger outlet passage positioned between the flow passages and the outlet. Air flow allowed by either of the control pistons impinges on an end of the outlet piston, displacing it from a normally closed to an open position to permit air flow through the larger outlet passage.

17 Claims, 11 Drawing Figures

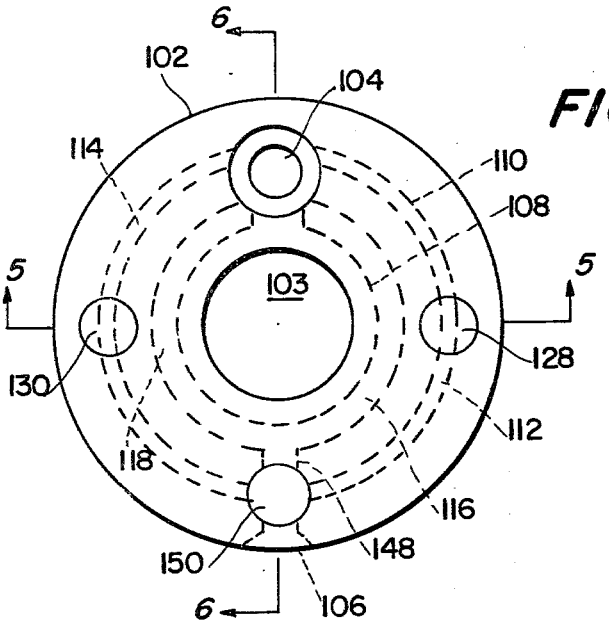
FIG. 4
FIG. 5
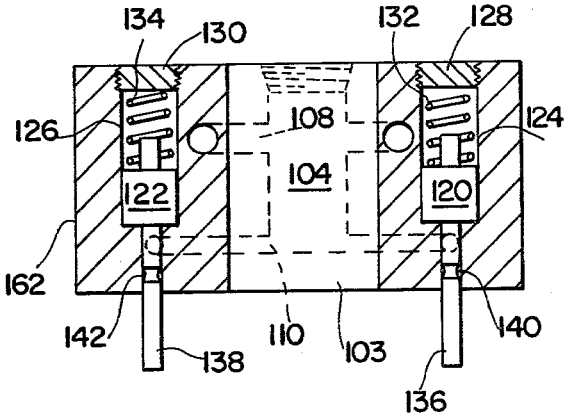
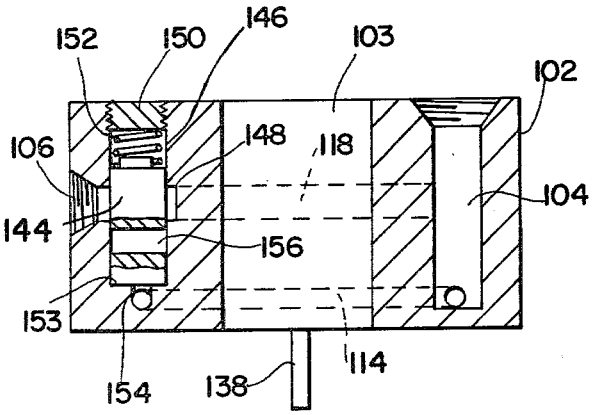
FIG. 6
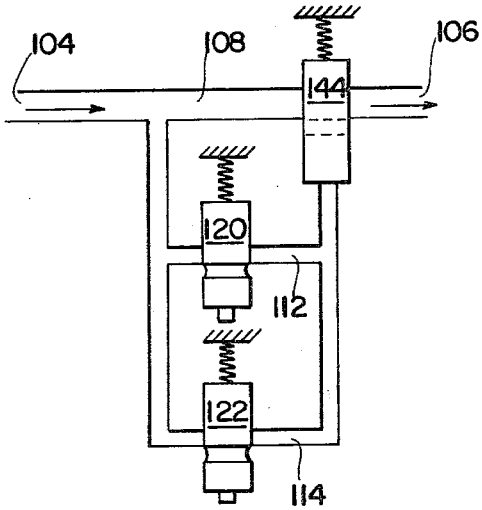
FIG. 7

PNEUMATIC VALVE

BACKGROUND OF THE INVENTION

Underwater salvage operations by "Hard-hat" and "Scuba" divers typically necessitate the tiring and time consuming determination of the locus of the item to be recovered. Once found, salvage operations requiring much labor, such as carrying and attaching heavy, stiff hoisting cables to the salvage item, may be almost impossible due to the additional exertions of the diver and the concomitant use of breathing air. These factors severely limit the time a diver has to work on the project underwater.

An attempt to solve these problems is exemplified in U.S. Pat. No. 3,813,177, issued May 28, 1974 to Howard Cartwright for a "Recovery Cable Connector for Diver-swimmer", which is incorporated herein by reference. Briefly, the cable connector of Cartwright comprises an engageable male and female part. The female part may be shackled to the salvage item and the male part connected to floatation gear or a hoisting cable. A hauling line, of plaited nylon, attached to the male part, extends coaxially out its head and is threaded into its opening and over a sheave in the female so that hauling of the line causes the parts to be brought into union whereupon spring-loaded latches on the female part engage an enlarged head of the male part. When the two parts engage, spring-biased electrical contactors contact the female part closing an electrical circuit to thereby signal the engaged condition to a surface ship to begin hoisting or to cause actuation of an explosive valve to allow a pressurized fluid from a source to inflate the floatation gear and thus bring the salvage item to the surface.

The above apparatus of Cartwright suffers from several deficiencies. First, the explosive valve is limited to a one time use adding to the operational costs of the system. Second, inasmuch as the valve is classified as an explosive, it requires the expensive and hazardous use of a storage magazine. Third, presently available explosive valves do not readily and inexpensively meet the stringent non-magnetic requirements of present military specifications. The non-magnetic criterion may be crucial when the item to be salvaged is an unexploded ordnance which may be capable of being armed by even a slight change in its ambient magnetic field. The dangers in having magnetic equipment nearby to such ordnance can be readily seen. It would thus behoove a designer and user of salvage equipment to insure the use of non-magnetic materials in such equipment. Fourth, the explosive valve is controlled by a firing lead assembly which requires a small battery to provide power for actuation of the explosive valve. Fifth, to ensure proper and reliable actuation of the valve, the battery should not have been used previously nor should it have experienced very long shelf life. This can lead to waste. Sixth, since the apparatus of Cartwright is to be used underwater and invariably in ocean environments of high salinity, there is the omnipresent danger that leakage into the battery box may occur with a concomitant battery shorting potential. Finally, the use of a battery in Cartwright requires the use of electrical leads which are unprotected and subject to pulling, loosening, cutting and other underwater harzards thereby potentially reducing the reliability of the apparatus.

SUMMARY OF THE INVENTION

Accordingly, an object of the present invention is to provide an improved cable connector suitable for salvage operations.

Another object of the instant invention is to provide a pneumatic valve reducing the complexity of a cable connector.

A further object of the invention is to provide a pneumatic valve for the use in a cable connector which eliminates the need for an explosive valve.

A still further object of the present invention is to provide a pneumatic valve which can be used repetitively with a cable connector.

Yet another object of the instant invention is to provide a pneumatic valve, for use in controlling the inflation of flotation bladders in a recovery cable connector, which enhances safety and reduces cost during storage and use.

Yet still another object of the invention is to provide a pneumatic valve for use in salvage operations equipment apparatus which meets present non-magnetic requirements for certain military needs.

Briefly, these and other objects of the present invention are attained in a pneumatic valve for controlling the inflation of floatation bladders in a diver-deployed underwater recovery apparatus. The valve comprises an inlet connectable to a source of pressurized air; two independent flow passages joining the inlet to an outlet which connects to the bladders, a pair of spring-loaded control pistons mounted in the smaller of the two flow passages and another spring-loaded outlet piston positioned between the larger flow passage and the outlet. Air passes by either of the control pistons, impinges on the end of the outlet piston, displacing it from the closed to the open position to permit air flow through the larger passage.

The pneumatic valve is attached to the male portion of a two-part recovery cable connector. Upon contact between the parts of the cable connector, the spring-loaded control pistons are depressed, permitting air flow to the outlet piston and subsequent inflation of the floatation bladder. An alternative configuration eliminates the outlet piston, with air flow directly to the bladder past the control pistons.

BRIEF DESCRIPTION OF THE DRAWINGS

A more complete understanding of the invention and many of the attendant advantages thereof will be readily appreciated as the same becomes better understood by reference to the following detailed description when considered in connection with the accompanying drawings wherein:

FIG. 4 shows a top view of the valve.

FIG. 5 is a cross-sectional view of FIG. 4 taken along line 5—5.

FIG. 6 is a cross-sectional view of FIG. 4 along line 6—6.

FIG. 7 is a schematic representation of the pneumatic valve of FIG. 4.

DESCRIPTION OF THE PREFERRED EMBODIMENT

Figure 1:
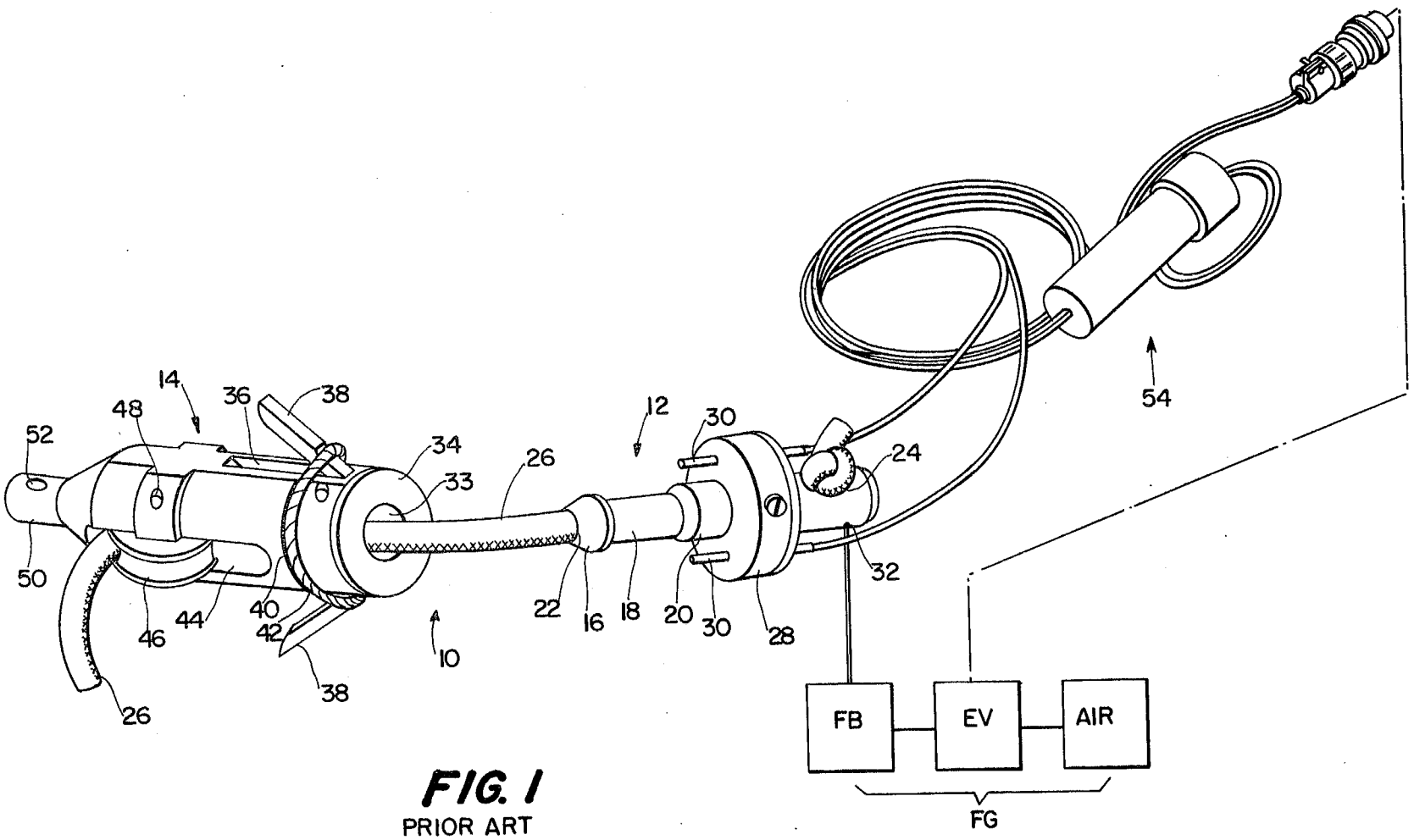
FIG. 1 PRIOR ART
FIG. 1 is an overall representation of the cable connector of the prior art.

Referring now to the drawing, there is shown in FIG. 1 generally a cable connector 10, having a male part 12 and a female part 14. The male part comprises an enlarged head 16, a shaft 18 having a reduced diameter and base 20. Bored coaxially through the male part is a passage 22 open at the head 16 and exiting at the base 20 by an intersecting angular hole 24 to form a communicating passage. A plaited nylon hauling line 26 is knotted at hole 24 and extends out passage 22 at head 16.

Affixed about the base 20 of the male part 12 is an insulating ring 28 having therein a pair of spring-loaded electrical contactors 30. A transverse hole 32 in base 20 may be used to connect the male part 12 to lifting gear (not shown) or floatation gear shown collectively as FG. The female part 14 of the cable connector 10 comprises a barrel 33 having a bell-mouthed entrance 34. A plurality of latches 38 in slots 36 intersecting with the barrel 33 are pivotally attached to the body of the female part 14 to engage head 16 of the male part 12 when inserted. A circumferential groove 40 about the body of the female part 14 has a helically wound spring 42 embracing the body and thereby the latches 38 to bias them inwardly.

At the inner end of the barrel 33 and open to the side of the body is a slot 44 containing a sheave 46 mounted for rotation about an axle pin 48 and having the hauling line 26 bent thereover. On the end opposite the bell-mouthed opening 34 of the female part is a lug 50 having a transverse hole 52 for attachment to a salvage item to be hoisted.

In operation, the floatation or hoisting gear is first attached to the base 20 of the male part by the use of hole 32 in any conventional manner, as for example by a shackle. A hauling line 26 which may be made of plaited nylon is threaded into the coaxial passage 22 in the tip 16 and out the intersecting hole 24 where it is knotted. A diver takes the hauling line 26 and female part 14 with him and descends to the salvage item. He attaches the female part 14 to the salvage item by the use of hole 52 in lug 50 in any conventional manner as for example by a shackle. He then inserts the hauling line 26 into the bell-mouthed entrance 34 in the female part 14, through the barrel 33, and out the slot 44 over the sheave 46. Upon reaching the surface the diver pulls on the hauling line 26 drawing the male part 12 to a position adjacent the female part 14, where the tip 16 enters the entrance 34 readily due to the bell-mouthed shape into the barrel 33 where the latches 38 are cammed outwardly against the spring 42. Finally, when full penetration is achieved, the latches spring inwardly gripped behind the head of the reduced diameter of the shaft 18. In this position, the spring-biased electrical contactors 30, in the insulating ring 28, contact the female part closing an electrical circuit comprising a firing lead and battery box assembly 54 which thereby signals the condition of engagement to a surface ship to begin hoisting or to actuate an explosive valve EV. Valve EV forms part of the floatation gear FG and controls the flow of a high pressure fluid or gas from a source AIR which is capable of rapidly inflating a floatation bladder FB thus bringing the item to be recovered to the surface.

Figure 2:
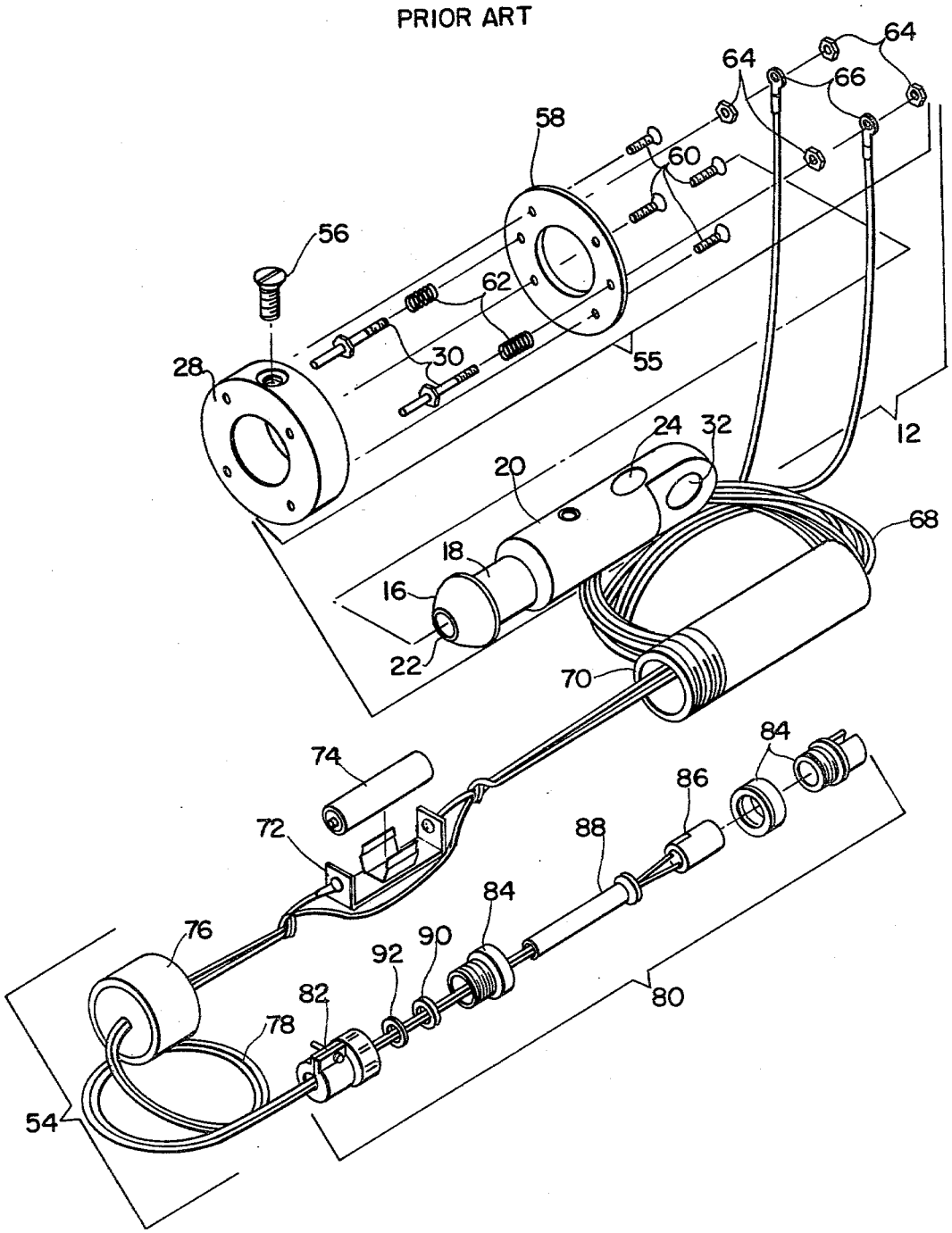
FIG. 2 PRIOR ART
FIG. 2 is a break-away view of the male part, firing lead and battery box assembly of the prior art.

FIG. 2 shows an expanded view of the male part 12 of the cable connector 10 and the associated firing lead and battery box assembly 54 of the prior art. A contact ring assembly 55 is shown, comprising the base or bladder attachment 20 which is fitted within insulating ring 28 by means of a flat head screw 56. An insulating ring cover 58 is attached to insulating ring 28 by means of flat head screws 60 thereby compressing springs 62 which spring load contactors 30. Plain hex nuts 64 allow the connection of terminal lugs 66 and an electric cord 68 to electrical contactors 30.

Electrical cord 68 leads to the firing lead and battery box assembly 54 which comprises a battery box 70 housing a battery holder 72 and battery 74. A battery box cap 76 seals box 70 from the ambient environment.

An electric cord 78 electrically connects firing lead and battery box assembly 54 with an incorporated firing lead adapter 80. Adapter 80 comprises a cable clamp 82, back shell 84, insert 86, telescoping bushing 88, rubber washer 90 and fibre washer 92. Adapter 80 electrically communicates with the explosive valve EV providing the valve with actuation power when spring-biased contactors 30 contact the female part thereby closing the electric circuit.

To overcome the deficiences of the prior art, mentioned supra, a pneumatic valve 100, made entirely of non-magnetic materials, has been incorporated in an improved male part 12' (shown in FIG. 3) thereby obviating the need for the contact ring assembly, forming lead and battery box assembly, firing lead adapter and explosive valve.

Figure 3:
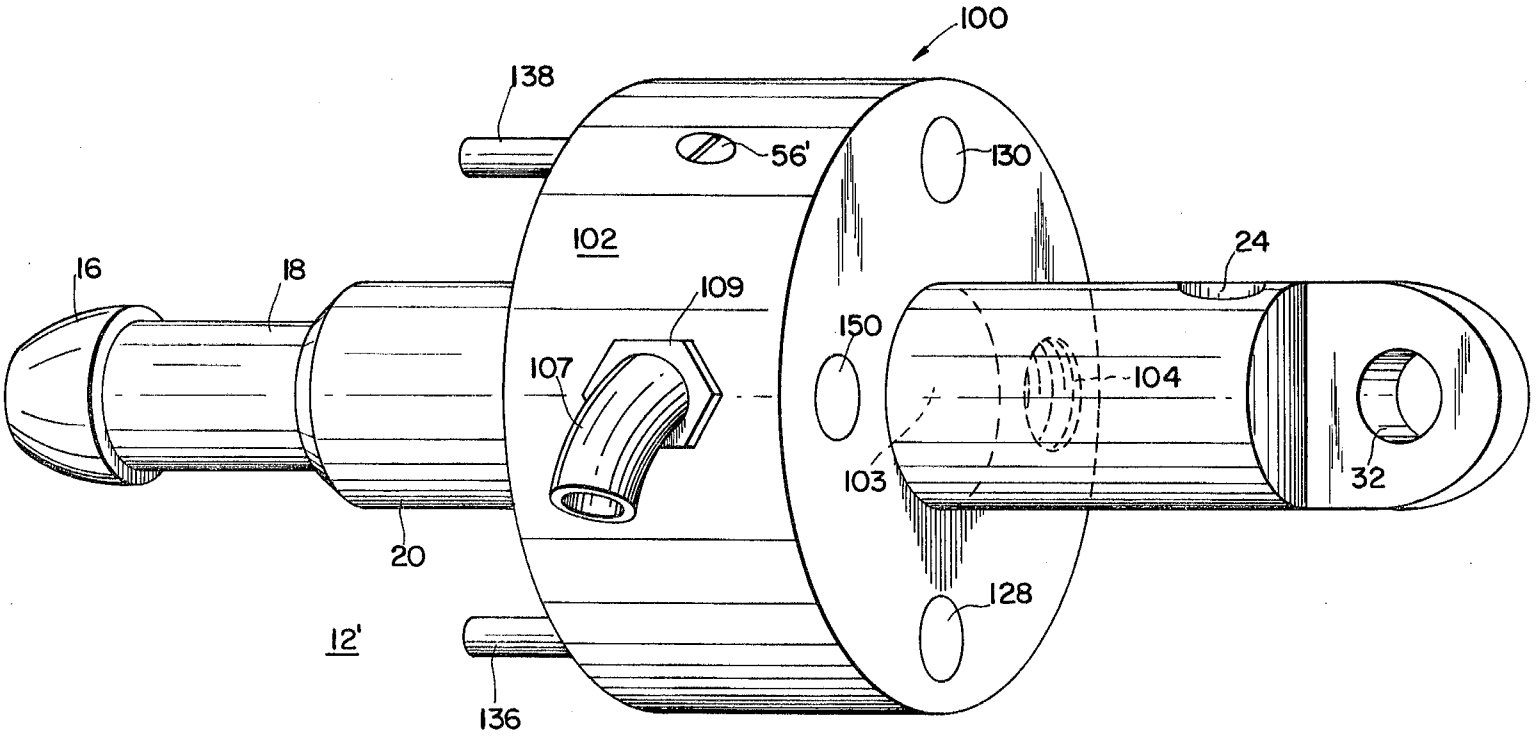
FIG. 3 is a perspective view of a male part in combination with one embodiment of the pneumatic valve of the present invention.

Referring next to FIG. 3 wherein a valve housing 102, having a generally cylindrical body is shown as having a central hole 103 to allow for the provision of a bladder attachment or base 20. Means such as flat head screw 56' can be used to fix base 20 to housing 102. The valve housing is also shown (see FIG. 4) as having means such as a threaded gas inlet 104 which is connectable to a source of high pressure fluid or gas, which although not shown in this figure, could be air cylinders AIR.

Inlet 104 communicates with a threaded gas outlet 106 by means of a plurality of tubular fluid passages 108, 110. Outlet 106 communicates, via a flexible hose 107, with an expansible member such as the floatation bladder FB schematically shown in FIG. 1. Hose 107 may be affixed to outlet 106 by any means, e.g. hose fitting 109. As can be seen control passage 110 connects inlet 104 to outlet 106 by means of two semi-circular flow paths 112, 114 which act fluidly in parallel. Similarly main actuating fluid passage 108 is comprised of two parallel semi-circular paths 116, 118. Paths 112, 114 have a cross-sectional area which is less than the cross-sectional area of paths 116, 118 and are disposed in a lower portion of the housing than paths 116, 118.

Positioned within paths 112, 114 are a pair of spring-biased obturating control pistons 120, 122 respectively. Pistons 120, 122 ride in cylindrical bores 124, 126 formed in valve housing 102. Each bore is open-ended at the surface of the housing where inlet 104 is located. These open bores are closed by means of threaded plugs 128, 130 which also compress compression springs 132, 134 biasing pistons 120, 122 downward as viewed in FIG. 5. Formed on a lower surface of each piston 120, 122 is an extended stem forming mechanical contactors 136, 138 respectively. Each contactor has a circumferential groove 140, 142 which allows the passage of fluid upon displacement of the pistons.

A main obturating actuating or outlet piston 144 (see FIG. 6) rides in a cylindrical bore 146 formed in housing 102 proximate outlet 106. Bore 146 communicates with semi-circular passages 116, 118 via a small transfer port 148. The open end of bore 146 is sealed by means of threaded plug 150 compressing a spring 152 which biases the undersurface 153 of piston 144 towards the closed end 154 of bore 146. A main actuating port 156 permits fluid flow from passage 118 to outlet 106.

The operation of the pneumatic valve 100, fitted about a base 20, can be readily seen by referring to the schematic in FIG. 7. As the male part 12' and the female part 14 are drawn together by the diver, by pulling on the hauling line 26, as explained supra, the spring biased contactors 136, 138 are depressed thereby causing control pistons 120, 122 to translate in their respective bores. When full penetration is achieved, pistons 120, 122 have moved to a position where grooves 140, 142 are aligned with paths 112, 114, respectively, thereby permitting the fluid to pass to a position where it can react on the undersurface 153 of main actuating piston 144. Since paths 112, 114 have a smaller cross-sectional area than paths 116, 118, high pressure is rapidly experienced by undersurface 153 which forces piston 144 to translate upwards in bore 146 against the action of biasing spring 152. This motion allows main actuating port 156 to align itself with path 108. Thus, fluid is allowed to flow from the pressure source to inlet 104 through path 108 past obturating piston 144, thereafter exit outlet 106 to hose 107 and ultimately inflate floatation gear, thus bringing a salvage item to the surface.

Important features of this embodiment include the redundancy of its mode of operation. The translation of either piston 120, 122 allows fluid to flow and thereafter impinge on actuating piston 144. This redundancy obviously adds to the safety and reliability of the valve. Furthermore, the use of the outlet piston 144 and the two control pistons 120, 122 ensure that the triggering of the mechanism and the inflation of a floatation balder cannot be effectuated until a positive connection between the male part and female part is effectuated thereby obviating a possible premature inflation of the bladder. Also, in addition to enabling the fluid to rapidly exert its influence on piston 144 via undersurface 153, the smaller cross-sectional area paths 112, 114 minimize the quantity of fluid necessary to actuate piston 144. Finally, as is apparent, pneumatic valve 100 is readily reusable inasmuch as no component is destroyed as would be the case in an explosive valve.

Figure 8:
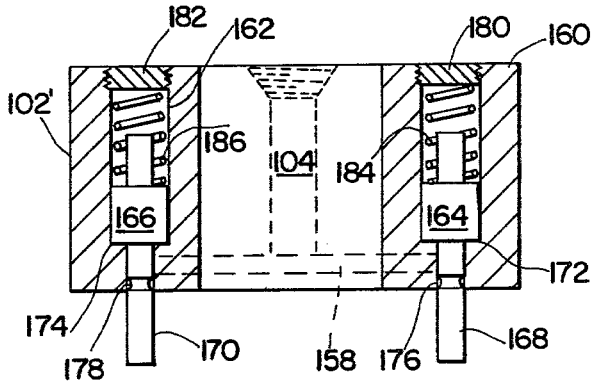
FIG. 8 is a cross-sectional view of an alternative embodiment of the pneumatic valve shown in FIG. 3 similar to the view of FIG. 5.
Figure 9:
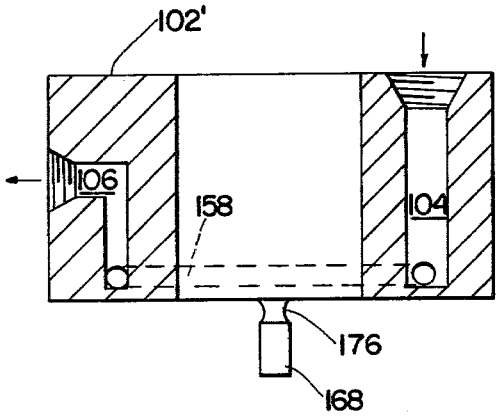
FIG. 9 is a cross-sectional view of the alternative embodiment similar to the view of FIG. 6.
Figure 10:
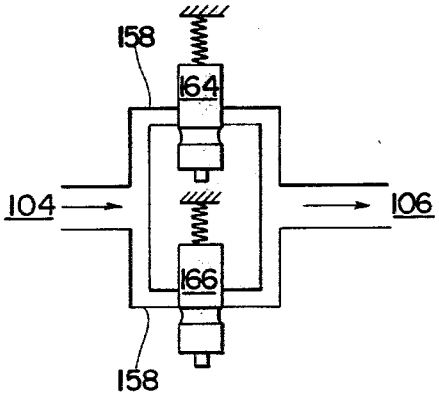
FIG. 10 shows a schematic view of the valve of FIG. 8.

An alternative embodiment is shown in FIGS. 8, 9, 10 wherein a valve housing 102' of cylindrical parallelpiped shape and constructed of any non-magnetic material, with a fluid inlet 104 communicating with an outlet 106 via a tubular circular passage 158 formed within housing 102' is shown. Open-ended bores 160, 162 are formed in housing 102' oppositely along a diameter intersecting passage 158 and provide for the translation of control pistons 164, 166. Stems 168, 170 are integrally formed at the lower portions 172, 174 of pistons 164, 166. Stems 168, 170 consititute the mechanical contactors of this embodiment and are provided with circumferential grooves 176, 178 respectively. Caps 180, 182 seal bores 160, 162 from the ambient environment and thereby compress springs 184, 186 which bias pistons 164, 166 downwards as viewed in FIG. 8. In the biased position, grooves 176, 178 are out of alignment with passage 158 and fluid cannot pass from the fluid inlet 104, which is connected to a source of fluid pressure, to the outlet, which is connected to a body requiring fluid pressure such as the floatation bladder mentioned earlier.

The schematic diagram of FIG. 10 is useful in illustrating the mode of operation of this embodiment wherein as the male part incorporating the pneumatic valve of FIG. 8 is drawn into contact with a female part the mechanical contactors 168, 170 are caused to translate. Upon full penetration, the pistons 164, 166 are depressed to the extent that grooves 176, 178 are aligned with passage 158. This valving action allows fluid flow to inflate the floatation badder, as is readily understood.

Figure 11:
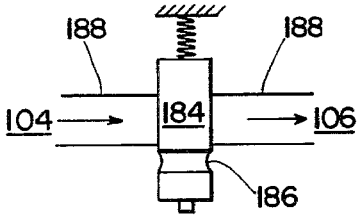
FIG. 11 shows a schematic of a single-piston pneumatic valve.

Finally, a less preferred embodiment of a pneumatic valve is shown in the schematic of FIG. 11. FIG. 11 shows a control piston 184 which acts as the single obturator between an inlet 104 and an outlet 106. Upon full penetration of a female part by a male part incorporating the valve of FIG. 11, the piston 184 is depressed to such an extent that groove 186 is aligned with a flow passage 188 which connects outlet 106 to inlet 104. The resulting fluid flow allows fluid from a source connected to inlet 104 to inflate a floatation badder communicating with outlet 106. The main advantages of the valve of FIG. 11 would be ease of manufacture and cost. However, this embodiment would not have the features of redundancy and safety of the valves of FIGS. 4 and 8.

Thus, what has been described are several embodiments which have many advantages: (1) reusability, (2) use of safe, ordinary and inexpensive storage space instead of costly storage magazines since there are no explosives. (3) meets fully the critical non-magnetic specifications specified earlier since there are no magnetic materials, (4) no requirement for a battery which is subject to failure, corrosion in a high salinity environment, (5) no necessity for vulnerable electric leads, (6) greater reliability due to a reduction of the complexity of the system, (7) reduction in weight and cost requirements and (8) increase in the safety in the use of handling of the system due to the elimination of explosives.

Obviously numerous modifications and variations of the present invention are possible in light of the above teachings. For example, various sizes of inlets and outlets determining gas flow rates can be used thereby controlling the time needed to fill the floatation bladder, rate of lifting force and the rate of air cylinder pressure reduction. It is therefore to be understood that within the scope of the appended claims the invention may be practiced than as specifically described.

What is claimed as new and desired to be secured by Letters Patent of the United States is:

1. A pneumatic valve for controlling the inflation of floatation bladders in diver-deployed underwater recovery apparatus, comprising:

a valve housing, a fluid inlet formed in said valve housing, said inlet being connectable to a source of pressurized fluid, a fluid outlet formed in said housing, at least one control flow passage formed in said housing communicating with said fluid inlet and said fluid outlet, said at least one control flow passage comprising a plurality of semi-circular flow paths, each of said flow paths communicating at one end with said fluid inlet and at the other end with said fluid outlet, spring-loaded control piston means displaceably mounted within and normally closing said control flow paths, control flow regulating means comprising a circumferential groove formed in said control piston means, means for actuating said pneumatic valve, and at least one floatation bladder in fluid communication with said fluid outlet, whereupon displacement of said control piston means and said control flow regulating means in said control flow paths by said means for actuating said pneumatic valve allows fluid from said source of pressurized fluid to flow from said fluid inlet through said control flow regulating means to said fluid outlet, thereby allowing said floatation bladder to be pressurized.

2. The valve of claim 1, further comprising a plurality of spring-loaded control pistons, one piston displaceably mounted in each of said flow paths, said pistons functioning in parallel such that upon displacement of a single piston, fluid from said source is allowed to pressurize said floatation bladder.

3. A pneumatic valve for controlling the inflation of floatation bladders in diver-deployed under-water recovery apparatus, comprising:

a valve housing, a fluid inlet formed in said valve housing, said inlet being connectable to a source of pressurized fluid, a fluid outlet formed in said housing, a main flow passage formed in said housing communicating with said fluid inlet and said fluid outlet, a spring-biased main piston displaceably mounted in a chamber in said main flow passage, said main piston normally obturating the flow of fluid in said main flow passage, a main flow regulating means associated with said main piston, said main flow regulating means comprising a main flow port extending through said main piston, at least one control flow passage formed in said housing communicating with said fluid inlet and said main piston chamber spring-loaded control piston means displaceably mounted within and normally closing said at least one control flow passage, control flow regulating means associated with said control piston means, means for actuating said pneumatic valve, and at least one floatation bladder in fluid communication with said fluid outlet, whereupon displacement of said control piston means and said control flow regulating means in said control flow passage by said means for actuating said pneumatic valve allows fluid from said source of pressurized fluid to flow from said fluid inlet through said control flow passage to said main piston so as to displace said main piston and said main flow regulating means in said main flow passage and allow fluid from said fluid inlet to flow through the main flow passage to said fluid outlet, thereby allowing said floatation bladder to be pressurized.

4. The valve of claim 3, wherein said at least one control flow passage comprises a plurality of semi-circular flow paths, each of said flow paths communicating at one end with said fluid inlet and at the other end with said main piston chamber.

5. The valve of claim 4, wherein said main piston in said chamber has a surface in fluid communication with said flow paths.

6. The valve of claim 5, wherein spring-loaded control piston means are displaceably mounted in and normally close each of said flow paths, whereupon displacement of said control piston means by the means for actuating said pneumatic valve, fluid flows through said flow paths to said undersurface in order to displace said main piston thereby allowing fluid to flow through said main flow passage and thereafter to said bladder.

7. The valve of claim 6, wherein the cross-sectional area of said flow paths is smaller than the cross-sectional area of the main flow passage so that the quantity of fluid required for actuation of said main piston is minimized.

8. The valve of claim 6, wherein said control flow regulating means comprises a circumferential groove formed in said control piston means, and wherein said main flow regulating means comprises a flow port formed in the main piston, whereby upon displacement of said control piston means by said means for actuating said valve, the associated groove aligns with the associated flow path thereby allowing fluid flow in said associated flow path in order to displace said main piston in said chamber and cause the port of said main piston to be aligned with said main flow passage thereby allowing fluid flow through said main flow passage to said fluid outlet.

9. A pneumatic valve for inflating floatation bladders in diver-deployed underwater recovery apparatus, comprising:

a valve housing, a fluid inlet formed in said valve housing, said inlet being connectable to a source of pressurized fluid, a fluid outlet formed in said valve housing, main flow means in fluid communication with said fluid inlet and said fluid outlet, at least one control flow passage formed in said valve housing communicating with said fluid inlet and said main flow means, said at least one control flow passage having a plurality of semi-circular flow paths, spring-loaded control piston means displaceably mounted within, and normally closing, said control flow paths, control flow regulating means associated with said control piston means, means for actuating said pneumatic valve, said actuating means being slidably mounted within said valve housing for movement normal to said control passage, said actuating means connected to, and cooperating with, said control piston means to cause displacement of said control piston means in said control paths in response to displacement of said actuating means, and at least one floatation bladder in fluid communication with said fluid outlet, whereupon displacement of said control piston means and said control flow regulating means by said actuating means allows fluid from said source of pressurized fluid to flow from said fluid inlet to said main flow means thereby operating said main flow means to allow fluid to flow from said fluid inlet to said fluid outlet, thereby allowing said floatation bladder to be pressurized.

10. The valve of claim 9, wherein said control flow passage comprises a plurality of semi-circular flow paths, each of said flow paths communicating at one end with said fluid inlet and at the other end with said fluid outlet, and wherein a spring-loaded control piston is displaceably mounted in each of said flow paths.

11. A pneumatic valve as set forth in claim 9 wherein said fluid inlet is disposed in said housing perpendicular to said control passage.

12. A pneumatic valve as set forth in claim 11 wherein said control piston means and said actuating means are displaceable in a first direction, and said fluid inlet extends in said first direction.

13. A pneumatic valve as set forth in claim 12 wherein said control passage extends normal to said first direction.

14. A pneumatic valve as set forth in claim 12 wherein said main flow means comprises a main flow passage with a main piston chamber, a spring-loaded main piston slidably disposed in said chamber, said main piston having a surface in fluid communication with said control flow passage, said chamber being disposed in said first direction and connecting said fluid inlet and said main flow passage with said fluid outlet, said main piston normally blocking flow to said fluid outlet, and a main flow regulating means associated with said main piston, whereupon displacement of said control piston means and said control flow regulating means by said actuating means allows fluid from said source of pressurized fluid to flow from said fluid inlet through said control flow passage to said main piston chamber thereby displacing said main piston and said main flow regulating means thereby allowing fluid to flow from said fluid inlet to said fluid outlet to pressurize said floatation bladder.

15. A pneumatic valve as set forth in claim 14 wherein said control flow regulating means comprises a circumferential groove formed in said control piston means.

16. A pneumatic valve for inflating floatation bladders in diver deployed underwater recovery apparatus comprising:

a housing having an inlet and an outlet, said inlet adapted to be connected to a source of pressurized fluid and the outlet adapted to be connected with an inflatable floatation bladder, said inlet disposed in a first direction, main flow means in fluid communication with the inlet and outlet including a main flow passage and a main piston chamber with a spring loaded main piston slidably mounted therein, main flow regulating means comprising a main flow port extending through said main piston and disposed in a second direction, said main flow regulating means becoming operative to permit fluid flow from said main flow passage to said outlet when said main piston is displaced in said chamber so that said main flow port becomes aligned with said main flow passage, control flow passage means in said housing communicating with said inlet and said main piston chamber, said control flow passage means extending noamal to said first direction, said main piston having an undersurface in fluid communication with said control flow passage means, spring-loaded control piston means displaceably mounted within, and normally closing, said control flow passage means, control flow regulating means comprising a circumferential groove formed in said control piston means, and actuating means for displacing the control piston means for positioning the control flow regulating means in communication with the control flow passage means, said actuating means being displaceable in said first direction, whereby pressurized fluid flows to the main piston chamber for moving the main piston to allow pressurized fluid to flow from the inlet to the outlet for pressurizing a floatation bladder.

17. A pneumatic valve as set forth in claim 16 wherein said at least one control passage, said fluid outlet and said main flow port extend in said second direction.

* * * * *